US010665956B2

(12) United States Patent
Li et al.

(10) Patent No.: US 10,665,956 B2
(45) Date of Patent: May 26, 2020

(54) ANTENNA STRUCTURE WITH HIGH GAIN AND BROAD ANGULAR COVERAGE USING MULTI-PORT SUB-ARRAYS AND BASEBAND SIGNAL PROCESSING

(71) Applicant: Hsueh-Jyh Li, Taipei (TW)

(72) Inventors: Hsueh-Jyh Li, Taipei (TW); Chi-Min Lee, Keelung (TW); Pao-Jen Wang, New Taipei (TW)

(73) Assignee: Hsueh-Jyh Li, Taipei (TW)

( * ) Notice: Subject to any disclaimer, the term of this patent is extended or adjusted under 35 U.S.C. 154(b) by 322 days.

(21) Appl. No.: 15/830,694

(22) Filed: Dec. 4, 2017

(65) Prior Publication Data

US 2018/0351260 A1 Dec. 6, 2018

(30) Foreign Application Priority Data

Jun. 5, 2017 (TW) ..... 106118502 A

(51) Int. Cl.
*H01Q 21/00* (2006.01)
*H01Q 3/36* (2006.01)

(52) U.S. Cl.
CPC ..... *H01Q 21/0025* (2013.01); *H01Q 3/36* (2013.01)

(58) Field of Classification Search
CPC combination set(s) only.
See application file for complete search history.

(56) References Cited

U.S. PATENT DOCUMENTS 8,604,989 B1 * 12/2013 Olsen ..... H01Q 25/008 343/700 MS
2010/0225413 A1 * 9/2010 Rofougaran ..... H01P 5/12 333/101
2011/0102263 A1 * 5/2011 Angeletti ..... H01Q 3/40 342/373
2015/0009069 A1 * 1/2015 Yun ..... H01Q 3/36 342/368
2016/0018509 A1 * 1/2016 McCorkle ..... G01S 5/12 342/386
2018/0269576 A1 * 9/2018 Scarborough ..... H01Q 3/30

* cited by examiner

*Primary Examiner* — Mamadou L Diallo
(74) *Attorney, Agent, or Firm* — Sinorica, LLC

(57) ABSTRACT

It is known in the field that conventional single-port antennas cannot provide both advantages of high gain and broad angular coverage. It is also known in the field that, for modern mobile communication systems, the transmitted signals generally include not only information data, but also pilot signals, which are used for both estimating real time channel responses and facilitating signals reception. Therefore, through a proper baseband signal processing arrangement, it is possible to effectively combine sub-arrays output signals of a multi-port antenna to substantially enhance interested signals. The present invention therefore makes use of the resources provided by the pilot signals to construct a novel antenna structure having multi-port sub-arrays and a baseband signal processing function unit, to simultaneously offer the advantages of high gain and broad angular coverage. In addition, the present invention is particularly suitable for use in millimeter wavelength antennas.

8 Claims, 4 Drawing Sheets

ANTENNA STRUCTURE WITH HIGH GAIN AND BROAD ANGULAR COVERAGE USING MULTI-PORT SUB-ARRAYS AND BASEBAND SIGNAL PROCESSING

BACKGROUND OF THE INVENTION

Field of the Invention

The present invention relates to antenna structure, especially to antenna structure using multi-port sub-arrays and baseband signal processing unit. The present invention proposes a novel antenna structure using multi-port sub-arrays and baseband signal processing unit to offer both advantages of high gain and broad angular coverage. The novel antenna structure can solve the problems that a conventional high gain antenna typically suffers, including that it is difficult to steer a conventional high gain antenna to an alignment direction due to a narrow angular coverage thereof, and that a wireless communication via a conventional high gain antenna can be easily interrupted by strong winds or vibrations. In addition, the present invention is particularly suitable for millimeter wavelength antenna applications.

Description of the Related Art

The conventional concept of a very high gain antenna is usually accompanied with a very narrow beamwidth. The narrower the beamwidth, the more difficult it is to steer the antenna to an alignment direction. In addition, vibrations due to strong winds or earth quakes can cause the high gain antenna mis-aligned and fail a communication system. Therefore, it is desirable that an antenna structure possesses both advantages of high gain and broad angular coverage so that the antenna structure can be insensitive to environment disturbances. However, it is impossible for a single port antenna to achieve such a contradictory property.

On the other hand, in modern wireless communication systems desired signals are usually transmitted together with pilot signals so that a real-time channel response can be obtained and the desired signals can be detected through the help of the pilot signals. Furthermore, through a baseband signal processor, signals from multi-port sub-arrays can be effectively combined to greatly enhance the desired signals.

As is known in the field, a traditional antenna has a single port, i.e., only one input/output terminal. For an aperture antenna, as the aperture gets larger, the antenna gain will become higher and the beamwidth will become narrower. Take a one dimensional array of antennas as an example, if the spacing between the antennas is half a wavelength and the element number of the antennas is N, then the maximum gain of the array will be N and the 3 dB angular beamwidth will be $\sin^{-1}(1/N)$. That is, as the element number gets larger, the maximum gain will become larger, the 3 dB angular beamwidth will become narrower to make the alignment of the array more difficult, and the array will become more sensitive to environmental disturbances.

SUMMARY OF THE INVENTION

The present invention proposes a novel antenna architecture consisting of multi-port sub-arrays (for transmitting RF (radio frequency) signals) and a baseband signal processing unit. The novel architecture is shown in FIG. 1.

Assume there are M sub-arrays, M being a positive integer; each of the sub-arrays has N antenna elements, N being a positive integer, and is steered to a different direction $\alpha_m$, which can be achieved by adjusting a progressive phase shift difference $\Delta\Psi$ between the antenna elements, where $\Delta\Psi$ can be expressed as $\Delta\Psi = kd\cos\alpha_m$, $k=2\pi/\lambda$, $\lambda$ being a wavelength, d being a spacing between the antenna elements, and the value of the progressive phase shift difference can be determined by adjusting the length of transmission lines. An RF output of each of the sub-arrays is then down-converted to the baseband and then digitized. The digitized output of each port is denoted by $y_m$. Each $y_m$ is then multiplied by a weighting factor $W_m$ and then summated to give a total output, which is expressed as $$y_T = \Sigma_{m=1}^{M} w_m y_m \tag{1}$$

Assume a plane wave from a direction $\Phi$ is illuminating the whole array. The $m^{th}$ sub-array will have an output given by $$y_m(\Phi) = \frac{1}{\sqrt{N}} \sum_{n=0}^{N-1} \exp[jnkd(\cos\Phi - \cos\alpha_m)] \tag{2}$$

$$|y_m(\Phi)| = \sqrt{N}\left|\operatorname{sinc}\left[\frac{N}{2}kd(\cos\Phi - \cos\alpha_m)\right]\right|$$

Next, the weighting factor $W_m$ for each sub-array is to be determined. In modern wireless communication systems, apart from transmitting the desired signals, the transmitter at the base-station or the user end also transmits pilot signals so that the receiver can measure or estimate the channel response from the pilot channel. Therefore, the channel response $y_m(\Phi)$ of each sub-array port can be obtained from the pilot channel. The weighting factor of each port is then given by $$w_m(\Phi) = \frac{y_m^*(\Phi)}{(\Sigma_{m=1}^{M} |y_m(\Phi)|^2)^{\frac{1}{2}}} \tag{3}$$

When a desired signal x is transmitted, the total output $y_T(\Phi)$ is given by $$\begin{aligned} y_T(\Phi) &= \sum_{m=1}^{M} w_m(\Phi)[y_m(\Phi)\cdot x + n_m] \\ &= \frac{\Sigma_{m=1}^{M} y_m^*(\Phi)\cdot y_m(\Phi)}{(\Sigma_{m=1}^{M} |y_m(\Phi)|^2)^{\frac{1}{2}}}\cdot x + \frac{\Sigma_{m=1}^{M} y_m^*(\Phi)\cdot n_m}{(\Sigma_{m=1}^{M} |y_m(\Phi)|^2)^{\frac{1}{2}}} \\ &= (\Sigma_{m=1}^{M} |y_m(\Phi)|^2)^{\frac{1}{2}}\cdot x + \frac{\Sigma_{m=1}^{M} y_m^*(\Phi)\cdot n_m}{(\Sigma_{m=1}^{M} |y_m(\Phi)|^2)^{\frac{1}{2}}} \end{aligned} \tag{4}$$

where $n_m$ is the noise of the $m^{th}$ sub-array.

In fact, the combination of Eq. (4) and the weighting factor defined by Eq. (3) is called the maximum ratio combining. Assume the noise variance at each port is given by $E\{|n_m|^2\}=\sigma^2$ for all m, the signal to noise ratio (SNR) of each port will be $SNR_m = |y_m(\Phi)|^2/\sigma^2$. It can be easily derived that the SNR of the whole antenna structure is given by $$SNR(\Phi) = \Sigma_{m=1}^{M} \frac{|y_m(\Phi)|^2}{\sigma^2} = \Sigma_{m=1}^{M} SNR_m \tag{5}$$

That is, the SNR of the whole antenna structure is the summation of the SNR of each sub-array. For the architecture of the sub-arrays of FIG. 1, the effective gain pattern of the whole antenna can be expressed by $$G_T(\Phi) = \Sigma_{m=1}^{M} N\,\mathrm{sinc}^2\left[\frac{N}{2}kd(\cos\Phi - \cos\alpha_m)\right] \tag{6}$$

In the architecture of FIG. 1, the desired phase shift $\Psi_n$ of each antenna element is expressed as $\Psi_n$=nkd cos $\alpha_m$ and can be achieved by adjusting the length of a transmission line connected with each antenna element, which will not increase much cost. The present invention is particularly suitable for millimeter wavelength applications due to a fact that as the millimeter wavelengths are short in length, the increase of the number of the antenna elements or the number of sub-arrays will not make the size of the whole antenna structure too large to be acceptable. On the other hand, under the requirement of high gain, the convenience of direction alignment and tolerance to external disturbances are more important issues to be taken care of. The novel architecture of the present invention can allow much larger freedom for direction alignment and larger tolerance to external disturbances.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

Figure 1:
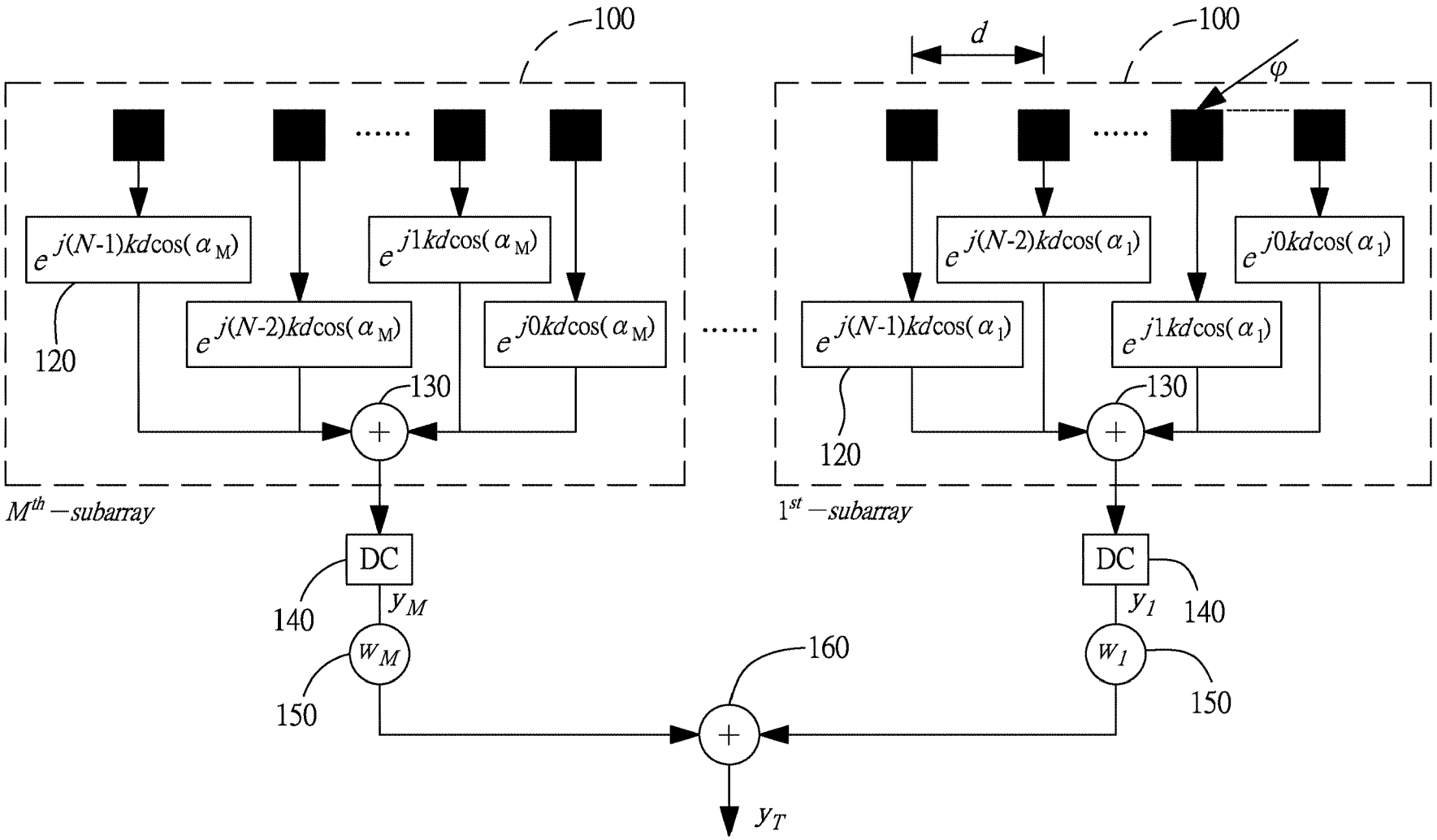
FIG. 1 illustrates an antenna structure using multi-port sub-arrays and baseband signal processing unit according to one embodiment of the present invention, which can offer both advantages of high gain and broad angular coverage.

As illustrated in FIG. 1, the antenna structure using multi-port sub-arrays and baseband signal processing unit of the present invention includes a plurality of sub-arrays 100, a plurality of downconverters 140, a plurality of weighting units 150 and a first combiner 160. Each sub-array 100 has a plurality of antennas 110, a plurality of phase shifting units 120, a second combiner 130 and a sub-array output port, where each antenna 110 is coupled to an input end of the second combiner 130 via one phase shifting unit 120, and the second combiner 130 has an output end coupled with the sub-array output port; each sub-array output port is coupled to an input end of a downconverter 140, each downconverter 140 has an output end for providing a sub-array output signal, each sub-array output signal is multiplied with a weighting value by a weighting unit 150 to generate a weighted signal, and the first combiner 160 is used to combine all of the weighted signals to provide a total antenna output signal; the sub-arrays 100 have different steering directions within a preset angular range, and the gain patterns of each two neighboring sub-arrays 110 are overlapping with each other; and each weighting value is proportional to a complex conjugate of a pilot signal channel response measured at the sub-array output port of one of the sub-arrays.

In the architecture of FIG. 1, the major design parameters include: the number M of the sub-arrays 100, the number N of the antenna elements of each sub-array 100, and the steering angular direction $\alpha_m$ of each sub-array 100. These parameters are related to design requirements. Assume the design requirements are: the antenna structure has a minimum gain $G_0$ within an angular coverage $\beta_0$, and there is a same steering angle difference $\Delta\alpha$ between each two neighboring sub-arrays. Then the parameters to be determined are (M, N, $\Delta\alpha$).

The gain pattern of each sub-array 100 is given by $$G_m(\Phi) = N\,\mathrm{sinc}^2\left[\frac{N}{2}kd(\cos\Phi - \cos\alpha_m)\right] \tag{7}$$

The maximum gain of each sub-array 100, as can be seen from equation (7), is N, and the gain pattern of the whole antenna structure, which is determined by equation (6), is a summation of the gain pattern of each sub-array 100. If the spacing between the antenna elements is set as d=$\lambda$/2, then each sub-array 100 will have a null-to-null beamwidth of $\Delta\phi$=2 $\sin^{-1}$(1/N) and a 3 dB beamwidth of $\Delta\phi_{3db} \simeq \sin^{-1}(1/N)$. Besides, according to equation (7), when the difference between the incident direction $\Phi$ of the electromagnetic waves and the steering angle $\alpha_m$ of the $m^{th}$ sub-array 100 gets larger, the gain of the $m^{th}$ sub-array 100 will become smaller. Therefore, if the steering angle difference $\Delta\alpha$ between adjacent sub-arrays 100 gets larger, then the total antenna gain will benefit less from most sub-arrays 100 due to a fact that the steering angle of most sub-arrays 100 will have a larger difference with the incident direction $\Phi$ of the electromagnetic waves. On the other hand, if the steering angle difference $\Delta\alpha$ gets smaller, then the total antenna gain will benefit more from most sub-arrays 100. Based on the principle mentioned above, the present invention proposes a rule of thumb:

Design goal: within an angular coverage of $\Delta\beta$, the total antenna gain is larger than $G_0$.

Design steps

Step 1: Determine the total number N of the antennas 110 of each sub-array 100 by letting $N \simeq G_0/3$.

Step 2: Determine the steering angle difference $\Delta\alpha$ between adjacent sub-arrays 100 by letting $$\Delta\alpha = \frac{1}{3}\sin^{-1}\frac{\pi}{Nkd} = \frac{1}{3}\sin^{-1}\frac{1}{N}$$

(with the setting of $$kd = \frac{2\pi}{\lambda} * \frac{\lambda}{2} = \pi\Big)$$

Step 3: Determine the total number M of the sub-arrays 100 by letting $$M = \frac{\Delta\beta}{\Delta\alpha} \simeq 3 * \frac{\Delta\beta}{\sin^{-1}\frac{1}{N}}.$$

Based on the design steps above, a sub-array structure can be realized to fulfill the design requirements.

Example illustration and simulation results:

Assume an antenna structure is to be designed to have a major direction at 90°, and have a total antenna gain larger than 24 within an angular coverage $\Delta\beta=20°$, i.e., $G_0=24$.

Based on the design rules above, the related parameters are determined as follows:

$$N = \frac{G_0}{3} = \frac{24}{3} = 8$$

$$\Delta\alpha = \frac{1}{3}\sin^{-1}\frac{1}{8} = 2.39°$$

$$M = \frac{\Delta\beta}{\Delta\alpha} = \frac{20°}{2.39°} \simeq 8$$

Figure 2:
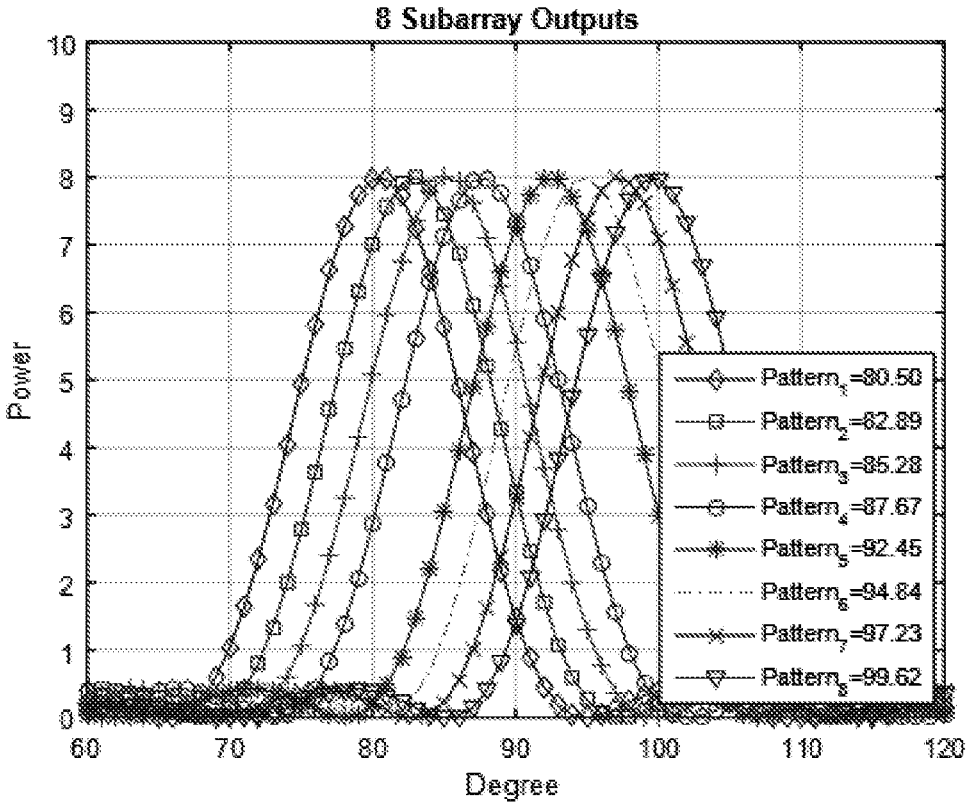
FIG. 2 illustrates the gain patterns of the sub-arrays according to one embodiment of the present invention.
Figure 3:
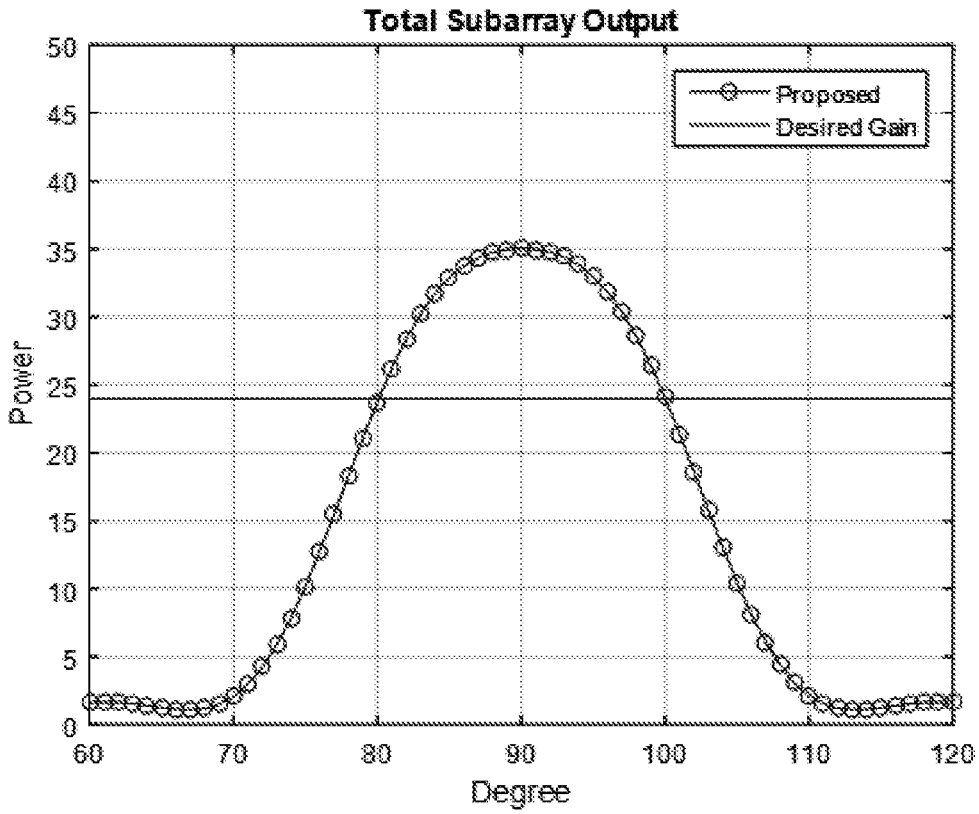
FIG. 3 illustrates the gain pattern of the whole antenna structure according to one embodiment of the present invention.

The steering directions of the sub-arrays 100 are then determined as listed below:

$a_1=80.5°$, $a_2=82.89°$, $a_3=85.28°$, $a_4=87.67°$, $a_5=92.45°$, $a_6=94.84°$, $a_7=97.23°$, $a_8=99.62°$, where, the steering angle of $\alpha=90.06°$ is not used due to a fact that the gains contributed by the sub-arrays 100 steered at the angles around 90.06° as listed above are already enough for meeting the total antenna gain requirement within the specified angular coverage. Based on the parameters above, the resultant gain patterns of the sub-arrays 100 are illustrated in FIG. 2 and the resultant gain pattern of the whole antenna structure is illustrated in FIG. 3, where, as can be seen in FIG. 2, each sub-array has a different steering direction, and as can be seen in FIG. 3, the gain of the total antenna gain is higher than 24 within the angular range 20°.

Figure 4:
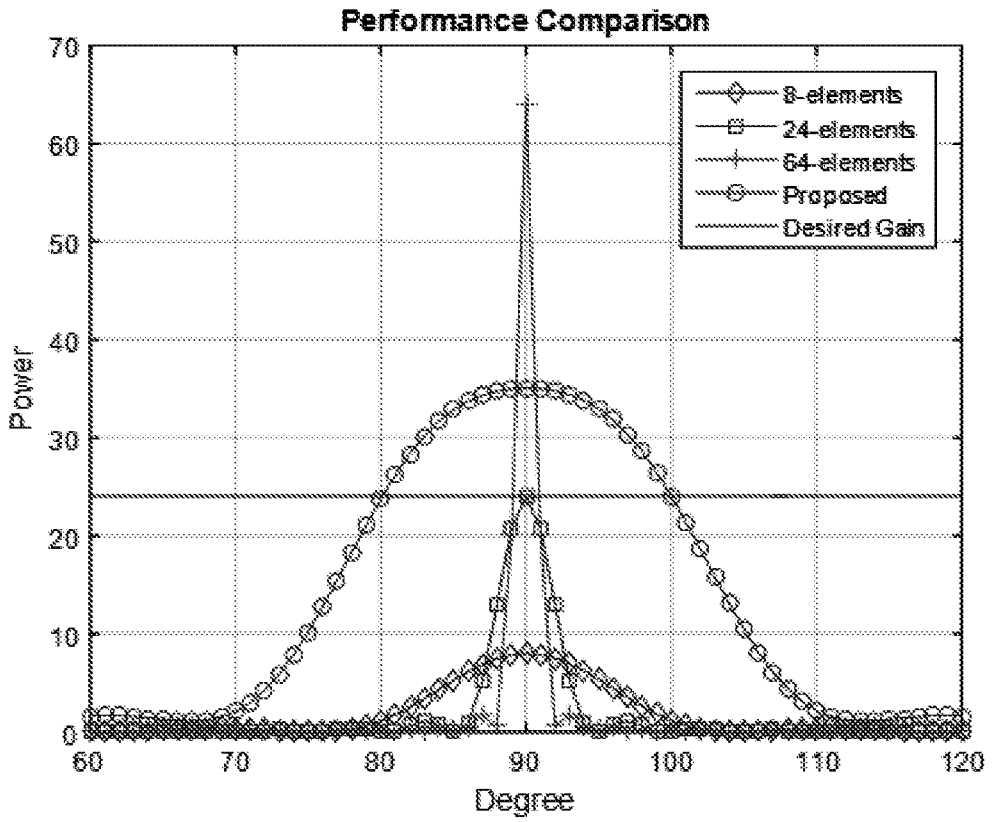
FIG. 4 illustrates the gain pattern of one embodiment of the present invention in comparison with the gain patterns of conventional antenna structures.

The gain performance comparison of the antenna structure of the present invention with several conventional single-port antenna arrays is listed in Table 1 and FIG. 4. As can be seen in FIG. 4, when the number of the antenna elements of the conventional single-port antenna array gets larger, the gain will become larger, and the beamwidth will become narrower, while the antenna structure of the present invention can offer both advantages of high gain and broad angular coverage.

TABLE 1

| | Single-Port Array | | | Multi-Port Array |
|---|---|---|---|---|
| Element Number | 8 | 24 | 64 | 8 × 8 = 64 |
| Maximum Gain | 8 | 24 | 64 | 35 |
| 3 db Beamwidth | $\sin^{-1}1/8$ = 72° | $\sin^{-1}1/24$ = 2.4° | $\sin^{-1}1/64$ = 0.9° | 20° |

Although the embodiment of the present invention illustrated above determines the steering direction of the sub-array by adjusting the length of a transmission line to result in a phase shift, it is to be noted that the steering direction of the sub-array can also be achieved by implementing the sub-arrays with broadside antenna arrays, of which each has a main beam direction perpendicular to an antenna plane thereof, and by aligning the normal direction of the antenna plane with the desired steering direction. In addition, the sub-arrays of the present invention can also be replaced with aperture antennas, for example horn antennas each having an aperture, and by aligning the direction of the aperture of each horn antenna to a corresponding desired direction, the same principle and same signal processing arrangement mentioned above can also be used to derive the resultant total antenna gain.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna structure using multi-port sub-arrays and baseband signal processing unit, including a plurality of sub-arrays, a plurality of downconverters, a plurality of weighting units, and a first combiner, each of the sub-arrays including a plurality of antennas, a plurality of phase shifting units, a second combiner and a sub-array output port, wherein each of the antennas is coupled with an input terminal of the second combiner via one of the phase shifting units, and the second combiner having an output terminal coupled with the sub-array output port; the sub-array output port of each of the sub-arrays being coupled to one input terminal of one of the downconverters, each of the downconverters including an output terminal for providing a sub-array output signal, the sub-array output signal being multiplied with a weighting value by one of the weighting units to generate a weighted signal, and the first combiner being used for combining all the weighted signals of the sub-arrays to provide a total antenna output signal, and the improvement comprising:

the sub-arrays being steered to different directions within a predetermined angular range, and two gain patterns of each two neighboring sub-arrays overlapping each other; and the weighting value of each of the weighting units being proportional to a complex conjugate of a pilot signal channel response measured at the sub-array output port of one of the sub-arrays.

2. The antenna structure using multi-port sub-arrays and baseband signal processing unit according to claim 1, wherein, the sub-array includes a first number of the antennas, and the first number is proportional to a predetermined minimum total antenna gain.

3. The antenna structure using multi-port sub-arrays and baseband signal processing unit according to claim 2, wherein, each two neighboring ones of the antennas have a spacing proportional to a wavelength of a plane wave.

4. The antenna structure using multi-port sub-arrays and baseband signal processing unit according to claim 3, wherein, each two neighboring ones of the sub-arrays are steered to two directions having an angle difference, and the angle difference is determined by an inverse sine function of an inverse of the first number.

5. The antenna structure using multi-port sub-arrays and baseband signal processing unit according to claim 4, wherein, the sub-arrays have a second number in total, and the second number is determined by a ratio of the predetermined angular range divided by the angle difference.

6. The antenna structure using multi-port sub-arrays and baseband signal processing unit according to claim 5, wherein, each two neighboring ones of the antennas have a progressive phase shift difference determined by a transmission line length difference of two corresponding ones of the phase shifting units.

7. The antenna structure using multi-port sub-arrays and baseband signal processing unit according to claim 6, wherein, the sub-arrays are aligned to different directions determined by the progressive phase shift difference and the spacing.

8. The antenna structure using multi-port sub-arrays and baseband signal processing unit according to claim 1, wherein, the sub-array includes a broadside antenna array, and the broadside antenna array has a main beam direction perpendicular to an antenna plane thereof.

* * * * *